US007064487B2

(12) United States Patent
Klein et al.

(10) Patent No.: US 7,064,487 B2
(45) Date of Patent: Jun. 20, 2006

(54) PLASMA SCREEN WITH TILTED DISCHARGE ELECTRODES

(75) Inventors: Markus Heinrich Klein, Aachen (DE); Rob Snijkers, Heerlen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 200 days.

(21) Appl. No.: 10/474,479

(22) PCT Filed: Apr. 12, 2002

(86) PCT No.: PCT/IB02/01182

§ 371 (c)(1),
(2), (4) Date: Oct. 9, 2003

(87) PCT Pub. No.: WO02/084692

PCT Pub. Date: Oct. 24, 2002

(65) Prior Publication Data

US 2004/0113551 A1 Jun. 17, 2004

(30) Foreign Application Priority Data

Apr. 14, 2001 (DE) ..... 101 18 530

(51) Int. Cl.
*H01J 17/49* (2006.01)

(52) U.S. Cl. ..... 313/586; 313/582; 313/491

(58) Field of Classification Search ..... 313/582, 313/484, 491, 493, 609, 631, 634, 586
See application file for complete search history.

(56) References Cited

U.S. PATENT DOCUMENTS 5,742,122 A * 4/1998 Amemiya et al. ..... 313/582
6,339,292 B1 1/2002 Ha ..... 313/582

OTHER PUBLICATIONS

Patents Abstracts of Japan, vol. 1999, No. 13, Nov. 30, 1999, JP 11 213904 A.

* cited by examiner

*Primary Examiner*—Joseph Williams
*Assistant Examiner*—Kevin Quarterman

(57) ABSTRACT

Plasma screen comprising a carrier plate, an array of addressing electrodes on the carrier plate, a ribbed structure that partitions the space between the carrier plate and the front plate into plasma cells that are filled with a gas, and comprising a front plate, an electrode array of pairs of strip-shaped discharge electrodes on the front plate, that are arranged in pairs on either side of a discharge path at an angle of tilt to the front plate, a dielectric layer having a thickness d, that covers the electrode array of pairs of strip-shaped discharge electrodes on the front plate, the distance a between a pair of discharge electrodes and the addressing electrodes in a direction transversel to the discharge channel being varied, and the thickness d of the dielectric layer being essentially constant.

7 Claims, 3 Drawing Sheets

PLASMA SCREEN WITH TILTED DISCHARGE ELECTRODES

The invention concerns a plasma screen comprising a carrier plate, an array of addressing electrodes on the carrier plate, a ribbed structure on the carrier plate that partitions the space between the carrier plate and the front plate into plasma cells that are filled with a gas, and comprising a front plate, an electrode array of pairs of strip-shaped discharge electrodes on the front plate, that are arranged in pairs on either side of the discharge path at an angle of tilt to the front plate, and a dielectric layer of thickness d over the discharge electrodes.

In a plasma screen of the surface discharge type, light is generated in a plasma by a gas discharge in a three-electrode system. The three-electrode system comprises, for each picture element, one addressing electrode and two discharge electrodes, between which an alternating current is applied during operation.

Plasma screens of this type in accordance with the prior art comprise a transparent front plate and a carrier plate that are maintained at a distance from one another and have a peripheral hermetic seal. The space between the two plates constitutes the discharge space, in which a gas filling is enclosed for the gas discharge. Individually controllable plasma cells are formed by a ribbed structure with elongated parallel separating ribs on the carrier plate.

The flat inside of the front plate carries a number of pairs of elongated discharge electrodes that are arranged in pairs extending parallel to each other. The discharge electrodes are covered by a layer of a dielectric material. This results in capacitors connected in series that are composed of electrodes on the one hand and the plasma and the dielectric layer on the other. The capacitance of the capacitors acts as a charge-coupled memory between two alternating voltage pulses.

The inside of the carrier plate supports, between the parallel, elongated separating ribs, a number of elongated addressing electrodes that are likewise arranged in parallel.

In a color screen, the picture elements of the plasma screen are formed by three sub-pixels in the three basic colors red, blue and green and by a phosphor layer on at least part of the carrier plate and/or on the walls of the separating ribs.

The front plate and the carrier plate are assembled in such a way that the longitudinal direction of the discharge electrodes is in an orthogonal position relative to the longitudinal direction of the addressing electrodes. Each of the points of intersection of a pair of discharge electrodes and an addressing electrode defines a plasma cell, that is a discharge region in the discharge space.

During operation, a rectangular alternating voltage (sustain voltage) of, for example, 100 kHz is applied to all the picture elements. The amplitude is, for example, 160 V and is therefore smaller that the igniting voltage. The sustain voltage and the igniting voltage are dependent upon the distance between addressing and discharge electrodes, the chemical composition and the gas pressure of the gas filling and the characteristics of the dielectric layer that covers the discharge electrodes. If a picture element is to be activated, then a voltage of between 160 V and 180 Volts is applied to the corresponding addressing and discharge electrodes, that triggers a gas discharge at the points of intersection in the discharge region. A stable gas discharge develops. The UV radiation that is emitted from the discharge region stimulates the phosphor layer to emit visible light that appears as a picture element through the front plate. The voltage pulse is also referred to as write pulse. A short-time current flows until the capacitors have been charged. At the same time a wall charge develops. The wall charge voltage adds to the subsequent negative impulse voltage of 160 V, so that another discharge is triggered. The capacitor is thus recharged again. This is repeated until the discharge is stopped by a quenching pulse. Thus, once activated, a picture element emits light until it is quenched. This is referred to as the memory function of the plasma screen. The quenching pulse is so short that a discharge of the capacitors can take place, but not a recharge. Without the wall charge voltage, the voltage is insufficient for ignition at the next pulse and the picture element remains dark.

From U.S. Pat. No. 5,742,122 a plasma screen of the discharge type is already known comprising a pair of a first and a second substrate that encloses a gas discharge space, a number of pairs of discharge electrodes that extend horizontally and are arranged on an inner surface of the first substrate, each pair of discharge electrodes including a pair of transparent electrodes, which are separated from each other by the discharge path and extend in the horizontal direction, and a pair of bus electrodes that each extend over the transparent electrodes or beyond the ends thereof and have a smaller area than the transparent electrodes, and comprising a dielectric layer that is formed on the inner surface of the first substrate and on the discharge electrodes, a number of addressing electrodes that extend vertically and are arranged on the inner surface of the second substrate, a number of separating ribs that extend vertically and are arranged between the addressing electrodes on the inner surface of the second substrate, in order to form a number of emission areas in the gas discharge space, the thickness of the dielectric layer over the bus electrodes being larger than over the transparent electrodes. The discharge electrodes can also be tilted so as to be at an angle to the plane of the front plate and extend into the dielectric layer.

By means of this arrangement of the electrodes, with a reinforced dielectric layer extending over the side of the strip-shaped electrodes facing away from the discharge gap, the spread of the gas discharge over the outer edge of the electrode pairs is prevented, since in plasma screens of the surface discharge type, the gas discharge tends to crosstalk, that is, the gas discharge extends from the discharge space along the discharge path and also excites neighboring picture elements. This reduces the contrast of the plasma screen.

Apart from the high manufacturing costs and the low daylight contrast, the low efficiency, in particular the very low discharge efficiency, is generally considered to be a disadvantage of plasma screens.

Therefore it is an object to improve the overall efficiency of the plasma screen of the surface discharge type and to develop a technology that is characterized by improved discharge efficiency and a higher power efficiency.

This object is achieved by a plasma screen comprising a carrier plate, an array of addressing electrodes on the carrier plate, a ribbed structure that partitions the space between the carrier plate and the front plate into plasma cells that are filled with a gas, and comprising a front plate, an electrode array of pairs of strip-shaped discharge electrodes on the front plate, that are arranged in pairs on either side of a discharge path at an angle of tilt to the front plate, a dielectric layer having a thickness d, that covers the electrode array of pairs of strip-shaped discharge electrodes on the front plate, the distance a between a pair of discharge electrodes and the addressing electrodes in a direction transversel to the discharge channel being varied, and the thickness d of the dielectric layer being essentially constant.

Particularly advantageous effects compared with the state of the art are revealed by the invention if the distance a between a pair of discharge electrodes of width b and the addressing electrodes across the discharge channel has a minimum.

The tilted arrangement of the strip-shaped discharge electrodes and the overlying dielectric layer causes the discharge path of the gas discharge to be extended, without simultaneously increasing the width of the sub-pixels. Relative to the overall discharge path, in this way the cathode drop region in the gas discharge, in which no UV light is generated, is also reduced. Therefore the luminous efficiency of the plasma screen increases, but without a simultaneous increase in power consumption. The efficiency of the plasma screen, which is defined as the ratio of the light emitted in the direction of the viewer to the energy consumption of the plasma screen can be significantly increased by this simple technical measure. The extended discharge path causes also the relative difference between the igniting voltage and the minimum sustaining voltage to be increased. By virtue of the larger relative difference between these voltages, exceptional operational reliability over a wide range of variation is possible. The size and the spatial distribution of the wall charges are improved and the plasma screen works more efficiently overall.

Within the scope of the present invention, it may also be preferred for the distance a of a pair of discharge electrodes from the addressing electrodes across the discharge channel to have a minimum that is flanked on either side by a maximum.

It can also be preferred for the discharge electrodes to be comb electrodes.

In accordance with an embodiment of the invention, the ribs of the carrier plate have transverse grooves for insertion of the ribs of the front plate.

In accordance with another embodiment, the ribs of the front plate have transverse grooves or transverse ridges for insertion of the ribs of the carrier plate.

By joining together the ribs of the front plate and of the carrier plate, crosstalk of the gas discharge to neighboring sub-pixels is prevented.

In the following the invention is further explained using 7 figures.

Figure 1:
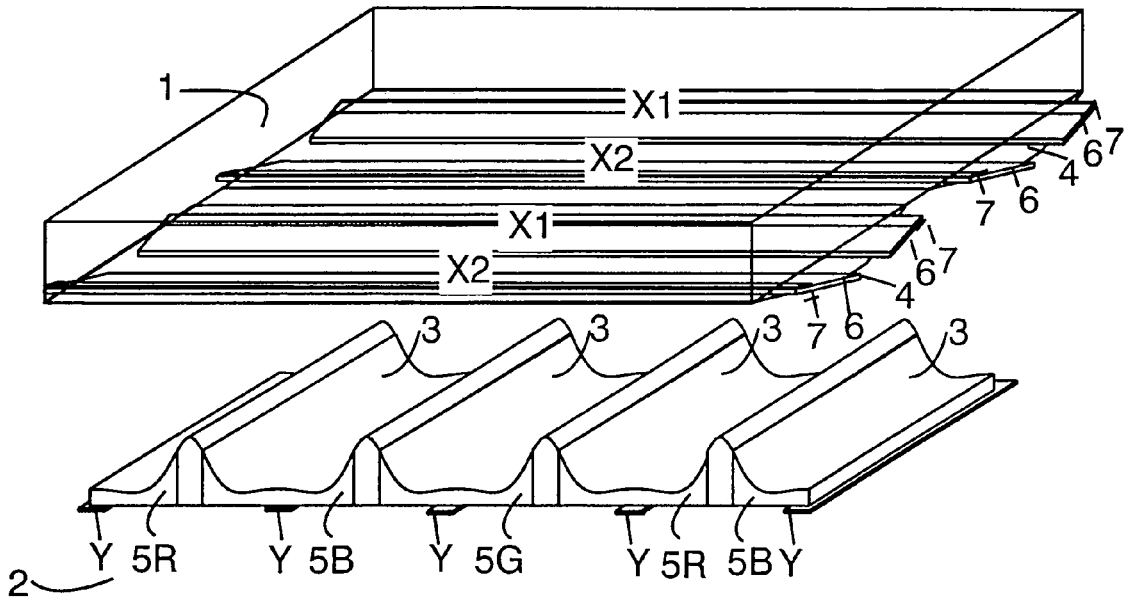
FIG. 1 shows a semi-perspective view of an embodiment of the plasma screen in accordance with the invention with a relief of ribs on the front plate.
Figure 2:
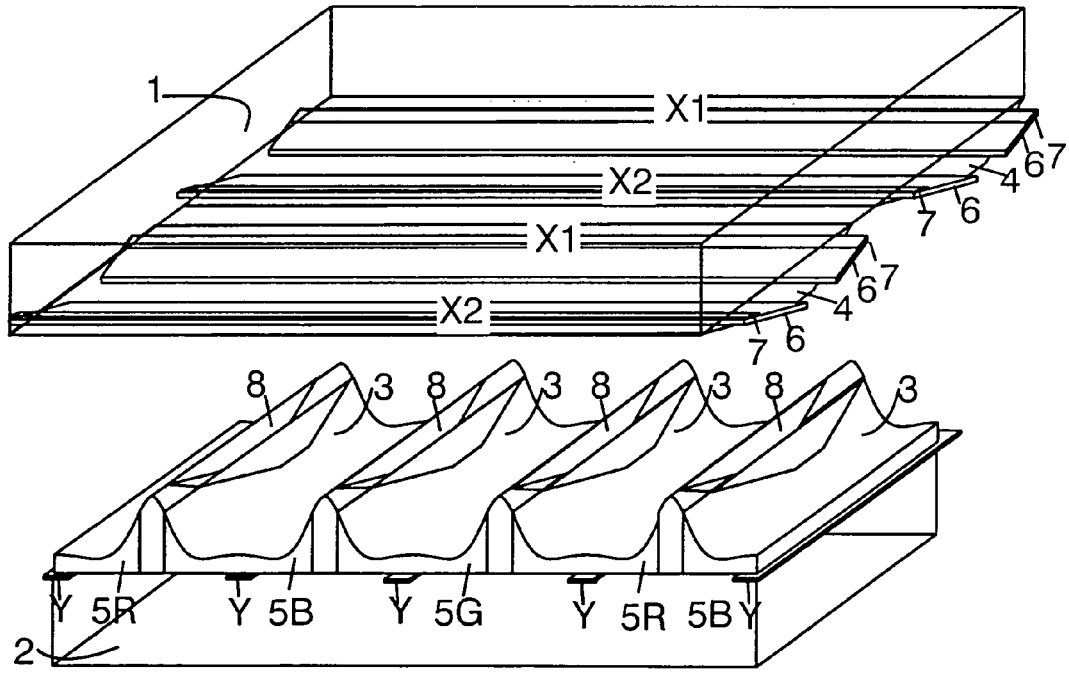
FIG. 2 shows a semi-perspective view of an embodiment of the plasma screen in accordance with the invention with a relief of ribs on the front plate and transverse grooves in the ribs of the carrier plate.

A first embodiment of an AC plasma screen of the surface discharge type in accordance with the invention is shown in FIG. 1. It is a color screen with a three-electrode configuration. An individual picture element, that is, a sub-pixel, is defined by a pair of discharge electrodes X1 and X2 and an addressing electrode y. The sub-pixels for each basic color of the color screen are arranged in a line; three sub-pixels for the three basic colors of red, green and blue form a pixel.

Considered in detail, the carrier plate comprises in succession a substrate 2 of glass, quartz or a ceramic, an electrode array of a number of elongated addressing electrodes y, that essentially extend parallel to each other on the substrate, phosphor layers 5R, 5B, 5G that cover the addressing electrodes, and also separating ribs 3 that form a ribbed structure. The separating ribs 3 of the ribbed structure are arranged between the individual addressing electrodes and run in the same direction as these.

The front plate likewise comprises a substrate 1. Normally this is transparent and consists of glass. On the inner surface the front plate has a relief with elongated ribs 4 that are arranged in parallel with one another. In accordance with an embodiment of the invention the ribs on the front plate are essentially trapezoidal in cross-section. The top of the rib marks a discharge gap and the valley between two ribs marks the distance between neighboring sub-pixels. In accordance with another embodiment, the top of each second rib marks the discharge gap of a sub-pixel, and the top of the intermediate ribs marks the distance between neighboring sub-pixels.

Figure 4:
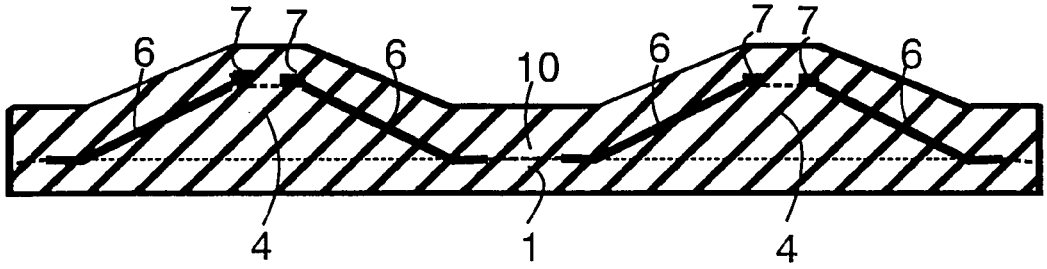
FIG. 4 shows a cross-sectional view of the front plate of the plasma screen in accordance with the invention through the ribs that are essentially trapezoidal in cross-section.
Figure 5:
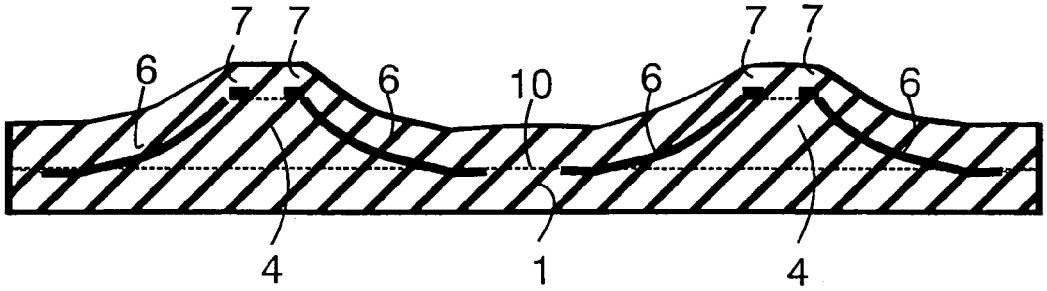
FIG. 5 shows a cross-sectional view of the front plate of the plasma screen in accordance with the invention through the ribs that are essentially trapezoidal in cross-section with concave arched side walls.
Figure 6:
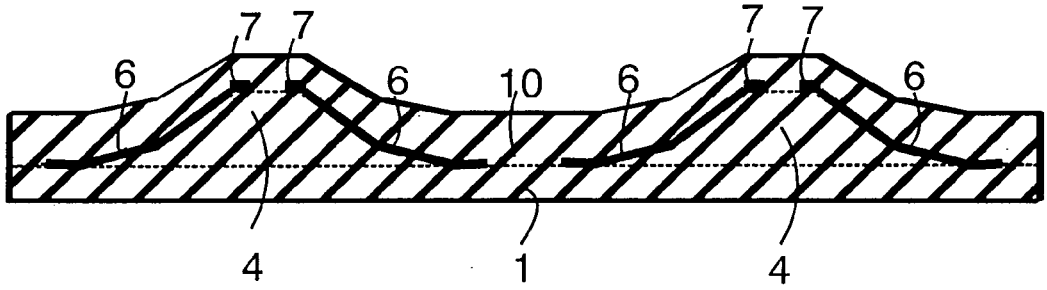
FIG. 6 shows a cross-sectional view of the front plate of the plasma screen in accordance with the invention through the ribs that are essentially trapezoidal in cross-section with concave kinked side walls.
Figure 7:
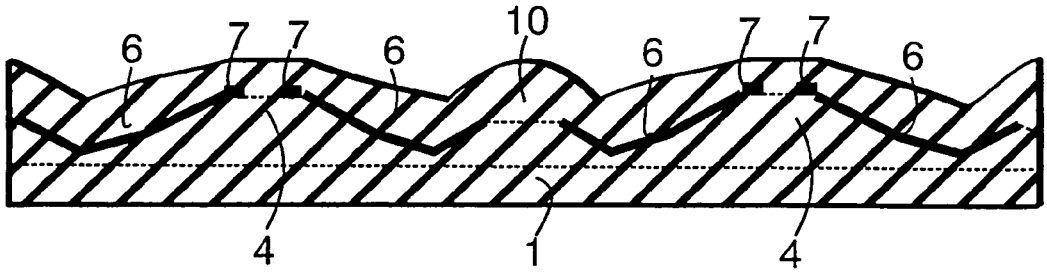
FIG. 7 shows a cross-sectional view of the front plate of the plasma screen in accordance with the invention, in which the distance a between the discharge electrodes and the addressing electrodes has a maximum.

The ribs that are essentially trapezoidal in cross-section 4 can have straight side walls in accordance with FIG. 4, or slightly concave arched side walls, in accordance with FIG. 5, or kinked side walls, in accordance with FIG. 6.

The front plate also comprises an array of pairs of elongated strip-shaped discharge electrodes X1, X2 that are formed on the relief of elongated ribs on the inner surface of the transparent glass substrate so as to extend parallel to each other. Each pair of discharge electrodes is arranged in pairs and separated by a discharge channel. Each individual discharge electrode preferably comprises a transparent strip electrode 6 and a metal bus electrode 7 that is laminated on the transparent strip electrode. The strip electrodes 6 are positioned on the lateral faces of the ribs 4 that are essentially trapezoidal in cross-section. They are arranged in pairs, so that each pair is separated by a discharge gap that is positioned on the top of an essentially trapezoidal rib. The form of the discharge electrodes is determined by the form of the side walls of the trapezoidal ribs and vice versa.

If the plasma screen is assigned an orthogonal system of coordinates x, y, z, so that x is the longitudinal direction of the discharge electrodes, y the longitudinal direction of the addressing electrodes, xy the plane of the two substrates and z the direction perpendicular to the substrates, then the plane of the flat strip electrodes is tilted in relation to the xy plane, so that the surface normals of the strip electrodes form an angle with the z direction and intersect below the front plate. The angle between the surface normals and the z direction is preferably <45°. The form of the cross-section of the strip electrodes, seen in cross-section, can be a flat, straight strip, however, the cross-section can also be arched or bent, depending on how the lateral faces of the essentially trapezoidal ribs on the front plate are designed. Examples of embodiments are shown in FIGS. 4, 5 6 and 7. The bus electrodes are advantageously applied as close as possible to the discharge gap. Bus electrodes are preferably made of metal and should preferably be designed without sharp edges. In this way high field strengths that otherwise develop at the transparent, thin strip electrodes, are avoided and a large proportion of the voltage applied externally is present across the gas space. The igniting voltage can be lowered markedly by this measure.

The discharge electrodes are each connected to a pole of a high voltage source, so that a high alternating voltage can be applied between neighboring electrodes.

The material of the transparent discharge electrodes is normally a transparent conductive material, such as Indium Tin Oxide (ITO) or non-stoichiometric tin oxide $SnO_x$.

The front plate also comprises a transparent first dielectric layer 10 that covers the electrode pairs. The transparent dielectric layer 10 has an essentially constant layer thickness d over the strip electrodes. Thus the relief of the dielectric layer essentially corresponds to the relief of the inner surface of the front plate.

For the high-voltage applications suitable materials for the dielectric layer are puncture-proof, electrically insulating materials (dielectrics), such as borosilicate glass, fritted glass, quartz glass, $Al_2O_3$, $MgF_2$ LiF and $BaTiO_3$.

The choice of dielectric material is not, however, restricted to these materials. Other dielectric materials with paraelectric, ferroelectric and antiferroelectric characteristics can equally be used.

Since both the front plate and the back plate have a relief with elongated ribs, it is advantageous if additional measures are taken in order to prevent crosstalk, i.e. the transfer of the gas discharge from one sub-pixel to neighboring sub-pixels in the x-direction.

For this purpose the pairs of discharge electrodes have alternating areas of different widths, within which the discharge is produced or suppressed. The electrodes are then arranged so that in each case two identical areas are opposite each other. In this way radial discharge structures are suppressed, and the discharge rather burns directly towards the next neighboring area of the counter-electrode.

Figure 3:
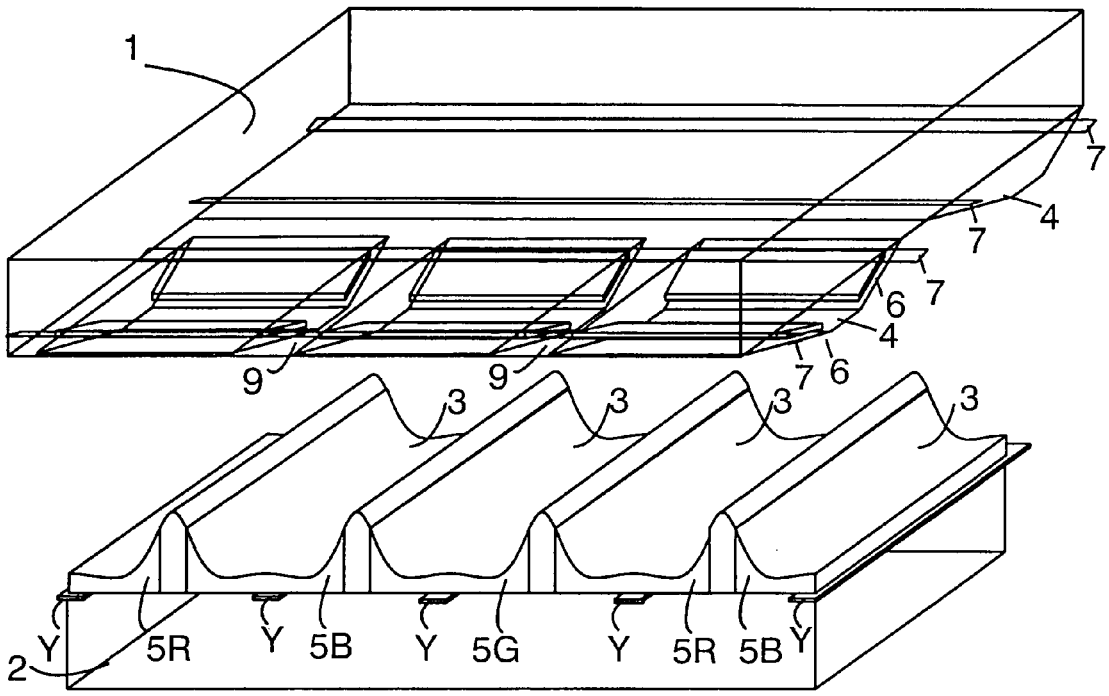
FIG. 3 shows a semi-perspective view of an embodiment of the plasma screen in accordance with the invention with comb electrodes and transverse grooves in the ribs of the front plate.

By way of example, FIG. 3 shows an embodiment of the discharge electrodes in which the strip electrodes are comb electrodes with comb-like slits and rectangular segments. The rectangular segments extend transversally to the longitudinal direction of the electrodes such that the segments of neighboring electrodes lie opposite each other at the same height and delimit the discharge channel. In accordance with another embodiment of the invention the segments can be trapezoidal.

The comb-like slits are repeated at regular intervals corresponding to the width of a sub-pixel. When the plasma screen is assembled, they are arranged such that they are positioned below the separating ribs of the carrier plate.

In accordance with another embodiment of the invention, crosstalk from one sub-pixel to a neighboring sub-pixel in the x-direction is prevented in that the separating ribs of the carrier plate have transverse grooves 8. The cross-section of the grooves and the mutual distance of the grooves is adapted to the cross-section of the ribs of the front plate and the mutual distance of the ribs.

According to a further embodiment of the invention, crosstalk from one sub-pixel to a neighboring sub-pixel in the x-direction is prevented in that the ribs of the front plate have transverse grooves. The cross-section of the grooves and the mutual distance of the grooves is adapted to the cross-section of the separating ribs of the carrier plate and the mutual distance of the seperating ribs.

In accordance with a preferred embodiment of the invention, that is shown schematically in FIG. 3, the ribs of the front plate can have transverse grooves 9 that are adapted to the form of the separating ribs of the carrier plate. At the same time the discharge electrodes have grooves that are arranged such that they are opposite to the ribs of the carrier plate.

In accordance with a further embodiment of the invention, crosstalk of the gas discharge from one sub-pixel to a neighboring sub-pixel in the x-direction can be prevented in that the front plate, in addition to the essentially trapezoidal barriers in the x-direction, has barriers that run in the y-direction, such that each sub-pixel is enclosed by two barriers running in the x-direction, and two barriers running in the y direction.

In order to manufacture a plasma screen in accordance with the invention, a front glass plate with a surface relief of elongated ribs of essentially trapezoidal cross-section is used. Such a front plate can be manufactured as a molded part by compression molding, centrifugal casting or extrusion. The transverse grooves can be milled in afterwards. Another way of manufacturing a front plate with parallel ribs of essentially trapezoidal cross-section, is to form the ribs by repeated screen-printing using a glass paste.

The cleaned glass surface is provided with a coating of indium tin oxide. By means of photolithographic masking and etching the strip electrodes are formed on the lateral sides of the trapezoidal ribs of the front glass plate.

In the next stage a material for the bus electrodes is vacuum evaporated onto the strip electrodes and structured using a photolithographic process and etching.

Next the electrodes and the free areas of the front plate are coated with a layer 10 of a dielectric material, such as glass paste, and then a second dielectric layer, containing MgO, can be applied.

The carrier plate is manufactured in accordance with known methods. First the addressing electrodes are produced by vacuum evaporation and structuring of a material. Then the ribs of the carrier plate can be produced, for example by means of repeated screen-printing with glass paste. The surfaces between the ribs of the carrier plate are coated alternately with a phosphor for red, green and blue.

The front plate with the discharge electrodes and the carrier plate with the addressing electrodes are interconnected in a gas-tight manner in such a way that the addressing electrodes and the discharge electrodes run at right angles to one another, and the gas space is filled with a gas mixture comprising, for example, an inert gas such as Xenon.

What is claimed is:

1. A plasma screen comprising:

a carrier plate, a front plate, an array of addressing electrodes on the carrier plate, a ribbed structure that partitions the space between the carrier plate and the front plate into plasma cells that are filled with a gas, and an electrode array of pairs of strip-shaped discharge electrodes on the front plate, that are arranged in pairs on either side of a discharge gap at an angle of tilt relative to the front plate, a dielectric layer having an essentially uniform thickness d, that covers the electrode array of pairs of strip-shaped discharge electrodes on the front plate, wherein a distance from the address electrode to a pair of discharge electrodes of the array of pairs in a vicinity of the discharge gap is less than the distance from the address electrode to the discharge electrodes at an area of the discharge electrodes farther away from the discharge gap.

2. The screen of claim 1, wherein the distance between the pair of discharge electrodes and the addressing electrodes across the discharge channel has a minimum.

3. The screen of claim 1, wherein the distance between the pair of discharge electrodes and the addressing electrodes across the discharge channel has a minimum that is flanked on both sides by a maximum.

4. The screen of claim 1, wherein the discharge electrodes are comb electrodes.

5. The screen of claim 1, wherein ribs of the carrier plate have grooves corresponding to ribs of the front plate.

6. The screen of claim 1, wherein ribs of the front plate have grooves corresponding to ribs on the carrier plate.

7. The screen of claim 1, wherein ribs of the front plate have ridges that transverse ribs of the carrier plate.

* * * * *